United States Patent [19]

Tincher et al.

[11] 4,342,658

[45] Aug. 3, 1982

[54] WATER-BASED HYDRAULIC FLUID CONTAINING AN ALKYL DIALKANOLAMIDE

[75] Inventors: Cline A. Tincher, Grosse Ile; Jerrold F. Maxwell, Woodhaven, both of Mich.

[73] Assignee: BASF Wyandotte Corporation, Wyandotte, Mich.

[21] Appl. No.: 209,817

[22] Filed: Nov. 24, 1980

[51] Int. Cl.[3] ..... C10M 1/44

[52] U.S. Cl. ..... 252/32.5; 72/42; 252/49.3; 252/78.5

[58] Field of Search ..... 252/49.3, 78.5, 32.5

[56] References Cited

U.S. PATENT DOCUMENTS

| | | | |
|---|---|---|---|
| 3,222,284 | 12/1965 | Cook | 252/75 |
| 3,249,538 | 5/1966 | Freier | 252/18 |
| 3,390,084 | 6/1968 | Lake | 252/49.3 X |
| 3,496,104 | 2/1970 | Shimada et al. | 252/49.3 X |
| 3,574,100 | 4/1971 | Wetmore | 252/49.3 X |
| 3,580,847 | 5/1971 | Boehmer et al. | 252/78.5 X |
| 3,629,112 | 12/1971 | Gower et al. | 252/49.3 X |
| 3,933,658 | 1/1976 | Beiswanger et al. | 252/31 |
| 3,945,930 | 3/1976 | Sugiyama et al. | 252/32.5 |
| 4,138,346 | 2/1979 | Nassry et al. | 252/32.5 |
| 4,151,099 | 4/1979 | Nassry et al. | 252/32.7 E |
| 4,215,002 | 7/1980 | Fein | 252/32.5 |
| 4,250,046 | 2/1981 | Przybylinski | 252/49.3 |

FOREIGN PATENT DOCUMENTS

| | | | |
|---|---|---|---|
| 1017951 | 1/1966 | United Kingdom | 252/49.3 |

*Primary Examiner*—Andrew Metz

*Attorney, Agent, or Firm*—Andrew E. Pierce

[57] ABSTRACT

Hydraulic fluids or metalworking lubricants are prepared utilizing mixture of water and, as lubricants and corrosion inhibitors, an alkyl dialkanolamide, a polyoxyethylene ester, and an ethoxylated alkylaryl phosphate ester. The compositions have improved extreme pressure lubricating and wear preventing characteristics and are non-flammable. The compositions can be thickened if desired using a polyglycol-type thickener and can contain conventional corrosion inhibiting and extreme pressure lubricating additives known in the prior art. Stable concentrates comprising a phosphate ester, a polyoxyethylene ether, and an alkyl alkanolamide can be prepared.

11 Claims, No Drawings

WATER-BASED HYDRAULIC FLUID CONTAINING AN ALKYL DIALKANOLAMIDE

BACKGROUND OF THE INVENTION

1. Field of the Invention

This invention relates to water-based lubricants, metalworking fluids and hydraulic fluids.

2. Description of the Prior Art

Water-based metalworking fluids are known in the prior art from ASLE Transactions 7, 398–405 (1964) by Beiswanger et al. Ethoxylated phosphate esters based upon dinonylphenol or oleyl alcohol are disclosed as suited for use as additives in metalworking lubricants. The combination of a phosphate ester and a sulfur compound as additives for metalworking fluid compositions is known from U.S. Pat. No. 3,933,658. Both these prior art metalworking fluids contain phosphate esters in a mineral oil-based vehicle. The patent also discloses the use of a glycol, a mineral oil-water mixture, and a glycol-water mixture as the base vehicle.

Water-in-oil, emulsion-type hydraulic fluids are known from U.S. Pat. No. 3,222,284. Such compositions contain, in addition to mineral oil, petroleum sulfonates, and certain metal alkyl dithiophosphates. The aqueous phase is about 33 to 45 percent by weight water. A lubricating composition is disclosed in U.S. Pat. No. 3,249,538 in which about 0.5 percent by volume mineral oil is utilized in combination with a major proportion of water and molybdenum disulfide. The composition can be thickened with water-soluble polymers such as polyalkylene glycols. There is no teaching that such compositions are useful as hydraulic fluids or metalworking fluids.

In U.S. Pat. No. 4,138,346 and U.S. Pat. No. 4,151,099, water-based hydraulic fluids are disclosed comprising a phosphate ester and a sulfur containing compound or a polyester of an oxyalkylene compound and a sulfur containing compound alone or including a phosphate ester. The compositions are also useful as metalworking fluids. Both polyethylene glycol and phosphate esters are disclosed as antiwear lubricant additives.

SUMMARY OF THE INVENTION

A water-based hydraulic fluid or metalworking composition can be obtained by blending water in a major proportion with minor effective lubricating amounts of a mixture of a phosphate ester, a polyethylene ester, a polyester of an oxyalkylene compound, and an alkyl dialkanolamide. Unexpectedly, the compositions of the invention provide improved wear resistance and resistance to precipitation in the presence of hard water as compared to prior art water-based hydraulic fluids and metalworking fluids.

The water-based compositions of the invention provide flame-retardant fluids having excellent lubricity and antiwear characteristics. As metalworking compositions, the compositions are useful to cool and lubricate surfaces which are in frictional contact such as turning, cutting, peeling, grinding, and the like. The compositions of the invention are ecologically superior to the hydraulic fluids and metalworking compositions of the prior art containing mineral oil or a glycol-water mixture.

DETAILED DESCRIPTION OF THE INVENTION

In accordance with this invention, it has been found that compositions useful as hydraulic fluids or metalworking compositions can be prepared having desirable lubricity and antiwear properties even in the presence of hard water. Generally, concentrates of the hydraulic fluids and metalworking fluids of the invention are shipped to the point of use where they are diluted with tap water. The compositions of the invention provide improved results over prior art fluids even when diluted with hard water.

The metalworking fluids and hydraulic fluids of the invention contain a minor effective amount of a phosphate ester salt selected from the group consisting of

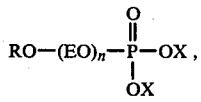

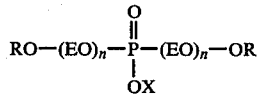

and mixtures thereof wherein EO is ethylene oxide; R is a monovalent alkylaryl group wherein the alkyl group thereof has about 4 to about 20 carbon atoms, X is individually selected from the group consisting of an alkali metal, an alkaline earth metal, the residue of ammonia, the residue of an amine, and mixtures thereof; n is generally a number from 1 to 50, and preferably 2 to 10.

The preparation of these phosphate esters is more fully disclosed in U.S. Pat. Nos. 3,004,056 and 3,004,057. In general, the phosphate esters utilized are obtained by esterifying one mole of a non-ionic surface-active agent. Such non-ionic surface-active agents are well known in the prior art and are generally prepared by condensing an alkylene oxide with a reactive hydrogen compound. Thus, one mole of the condensation product of at least one mole of ethylene oxide with one mole of an alkyl phenol having a reactive hydrogen atom is suitable. The amount of ethylene oxide utilized in the condensation product will depend primarily upon the particular alkylaryl phenol with which the ethylene oxide is condensed. Generally an amount of ethylene oxide is employed which will result in a condensation product containing about 20 to about 85 percent by weight of combined ethylene oxide. The optimum amount of ethylene oxide for the attainment of the desired hydrophobic-hydrophilic balance can be readily determined in any particular case by preliminary test and routine experimentation.

Examples of non-ionic surface-active agent condensation products are as follows:

nonyl phenol + 9 to 11 ethylene oxide,
dinonyl phenol + 2 ethylene oxide, and
dodecyl phenol + 10 ethylene oxide.

It is believed that certain of the advantageous properties of the phosphate ester are contributed by the phosphorus element of the ester. It is known that this element can contribute to antiwear and extreme pressure performance of a lubricant composition. The lubricity which is required in the metalworking and hydraulic fluid compositions of the invention is believed to be contributed primarily by the alkylaryl or polyethoxyethylene moieties. To obtain the necessary water solubility for such phosphate esters, a proper balance of hydrophilic-lipophilic properties is required. The ethoxylation of the alkyl phenol provides the necessary water solubility. Aqueous solutions of the phosphate esters are stable under neutral and alkaline conditions and show little tendency to hydrolyze during storage.

In addition to the required phosphate ester component, the metalworking and hydraulic fluid compositions of the invention contain an alkyldialkanolamide of the formula

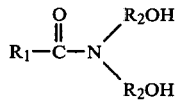

wherein $R_1$ is alkyl of about 4 to about 54, preferably about 4 to about 30, carbon atoms and $R_2$ is alkyl of about 2 to about 6 carbon atoms.

The alkyldialkanolamides are known compositions in the prior art. In general, these compositions are prepared by esterifying a dialkanolamine with an alkyl carboxylic acid and removing water of esterification. Useful alkyl carboxylic acids include branched or straight chain saturated or unsaturated aliphatic monocarboxylic or dicarboxylic acids as described below. Preferably, the saturated straight chain acids are used. Preferably, the amides are diethanolamides. Examples of useful alkyldialkanolamides are the alkyl diethanolamides and alkyl dipropanol amides where the alkyl group is derived from a $C_8$–$C_{54}$ dicarboxylic acid.

The advantageous properties contributed to the hydraulic fluid by the alkyldialkanolamide component of the hydraulic fluid or metalworking fluid of the invention are resistance to precipitation in the presence of hard water, that is, in the presence of large amounts of calcium and magnesium ions in the water utilized to prepare the hydraulic fluid or metalworking fluid of the invention. In addition, the alkyldialkanolamides contribute to the antiwear and extreme pressure performance of the lubricant composition as well as to the metal corrosion resistance which is desirable in such fluids. The alkyldialkanolamides in aqueous solution are completely stable under neutral and alkaline conditions and show little tendency to hydrolyze or decompose on storage.

As an antiwear lubricant component of the lubricating concentrates of the invention and of the hydraulic fluids and metalworking fluids of the invention, there are utilized water-soluble polyethoxylated aliphatic esters of the reaction product of ethoxylated about $C_8$ to about $C_{36}$, preferably about $C_8$ to about $C_{18}$, aliphatic monohydric or polyhydric alcohols with about $C_8$ to about $C_{54}$ aliphatic acids or aliphatic dimer acids. Such ethoxylated esters have a hydrophilic-lipophilic balance (HLB) in the range of 10 to 20. The most desirable adducts are in the HLB range of 13 to 18.

Useful aliphatic acids are oleic acid, stearic acid and palmitic acid. Useful dimer acids are oleic dimer acid and stearic dimer acid. Aliphatic acids can be either branched or straight-chain and can contain from about 8 to about 36 carbon atoms. Useful aliphatic acids include azelaic acid, sebacic acid, dodecanedioic acid, caprylic acid, capric acid, lauric acid, oleic acid, stearic acid, palmitic acid and the like. Especially useful acids for the purpose of obtaining the water-soluble esters of this invention are aliphatic, preferably the saturated and straight-chain, mono- and dicarboxylic acids containing from about 8 to 18 carbon atoms.

The dimer acids employed in the formation of the water-soluble esters employed in the aqueous lubricants of the present invention are obtained by the polymerization of unsaturated fatty acids having from 16 to 26 carbon atoms, or their ester derivatives. The polymerization of fatty acids to form the dimer fatty acids has been described extensively in the literature and thus need not be amplified here. The preferred dimer acids employed in the formation of the polyester are those which have 36 carbon atoms such as the dimer of linoleic acid and eleosteric acid. Other dimer acids having from 32 to 54 carbon atoms can be similarly employed. The dimer acids need not be employed in pure form and can be employed as mixtures in which the major constituent, i.e., greater than 50 percent by weight, is the dimer acid and the remainder is unpolymerized acid or more highly polymerized acid such as trimer and tetramer acid.

Useful representative aliphatic monohydric alcohols are n-octyl, n-decyl, n-dodecyl (lauryl), n-tetradecyl (myristyl), n-hexadecyl (cetyl) and n-octadecyl alcohol. Useful representative aliphatic polyhydric alcohols are ethylene glycol, diethylene glycol, polyethylene glycol, sucrose, butanediol, butenediol, butynediol, hexanediol and polyvinyl alcohol. Glycerol, sorbitol, pentaerythritol, trimethylolethane, and trimethylolpropane are particularly useful polyhydric alcohols which can be ethoxylated and subsequently esterified to produce the esters of ethoxylated aliphatic alcohols useful as essential components of the hydraulic fluids and metalworking compositions of the invention.

Suitable monohydric aliphatic alcohols are preferably those having straight chains and carbon contents of about $C_8$ to about $C_{18}$. The alcohols are generally ethoxylated so as to add about 1 mole to about 50 moles, preferably about 5 to about 20 moles, of ethylene oxide by conventional ethoxylation procedures known to those skilled in the art. Such procedures are carried out under pressure in the presence of alkaline catalysts. The most preferred monohydric aliphatic alcohols useful in producing the esters of the ethoxylated aliphatic alcohols of the invention are the commercial mixtures of linear primary alcohols having an average chain length of $C_{12}$–$C_{15}$ and sold under the trademark "Neodol 25-3" and "Neodol 25-7" by the Shell Chemical Company.

Representative water-soluble polyoxyethylated esters having about 5 to about 20 moles of oxide per mole of alcohol are the polyoxyethylene derivatives of the following esters; sorbitan monooleate, sorbitan trioleate, sorbitan monostearate, sorbitan tristearate, sorbitan monopalmitate, sorbitan monoisostearate, and sorbitan monolaurate.

Stable concentrates of the hydraulic fluids and metalworking fluids of the invention can be prepared so that the hydraulic fluids and metalworking fluids or the invention can be prepared at the point of use rather than manufactured and shipped to the point of use thus saving considerable expense in shipping costs. The concentrates can be made up completely free of water or can contain up to 20 percent by weight of water in order to increase the fluidity thereof and provide ease of blending at the point of use.

The proportion of phosphate ester or ethoxylated water-soluble aliphatic ester to alkyldialkanolamide is about 0.1:1 to about 2:1, preferably about 0.5:1 to about 1.5:1 based upon the total weight of the phosphate ester and the alkyldialkanolamide. Most preferably, equal amounts of the ester of an ethoxylated aliphatic alcohol and alkyldialkanolamide are used. Generally, the hydraulic fluids and metalworking fluids of the invention are made up to contain 80 to 95 percent by weight water with the total proportion of phosphate ester, polyester of an oxyalkylene compound, and alkyldialkanolamide being less than 5 percent by weight and the balance being made up by polymeric thickeners, corrosion inhibitors such as tolyltriazole and an imidazoline or an amine type vapor phase corrosion inhibitor.

The addition of conventional additives to the hydraulic fluids and metalworking fluids of the invention can provide the expected improvements usually contributed by prior art metal corrosion inhibitors, water-based polymeric thickeners, mineral oils, and pH adjusting compounds. Surprisingly, chelating agents such as the sodium salt of ethylene diamine tetraacidic acid are not required. For instance, sodium tolyltriazole and an imidazoline can be used for their known corrosion inhibiting properties with respect to cast iron and steel. Useful imidazolines are heterocyclic nitrogen compounds having the formula:

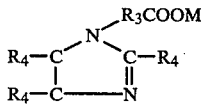

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms and where alkoxy derived from alkylene oxides selected from the group consisting of ethylene oxide, propylene oxide, butylene oxide, tetrahydrofuran and mixtures thereof and wherein M is an alkali metal.

Other additives known in the prior art which contribute to metal corrosion inhibition can also be added to the compositions of the invention. These include such known corrosion inhibitors of the prior art namely, amines, nitrites, and alkoxylated fatty acids. Useful amines are the aliphatic, cycloaliphatic and aromatic amines as illustrated by those listed below. Useful nitrites are the alkali metal or alkaline earth metal nitrites such as sodium nitrite, potassium nitrite, barium nitrite and strontium nitrite. Useful alkoxylated fatty acids are alkoxylated oleic acid, alkoxylated stearic acid, and alkoxylated palmitic acid; useful alkoxylated dimer acids are oleic dimer acid and stearic dimer acid.

Useful amine corrosion inhibitors include the aliphatic, heterocyclic, and aromatic amines including the alkanolamines. Representative examples are as follows: butylamine, propylamine, n-octylamine, hexylamine, morpholine, N-ethyl morpholine, N-methyl morpholine, aniline, triphenylamine, aminotoluene, ethylene diamine, dimethylaminopropylamine, N,N,-dimethyl ethanolamine, triethanolamine, diethanolamine, monoethanolamine, 2-methyl pyridine, 4-methyl pyridine, piperazine, dimethyl morpholine and methoxypropylamine. A preferred vapor-phase corrosion inhibiting compound is morpholine. The corrosion inhibitors are used in the proportion of about 0.05 to about 2 percent by weight, preferably about 0.5 to about 1 percent by weight on the basis of the total weight of the hydraulic fluid or metalworking composition of the invention.

It is often desirable to utilize in the metalworking and hydraulic fluid compositions of the invention a thickener. Generally about 1 to about 5 percent by weight, preferably about 1 to about 2 percent by weight of thickener is used. Preferably the thickener is of the polyglycol type, the use of which results both in an increase in viscosity and improved viscosity index of the composition. It has been found that this type of thickener has particular advantages from the standpoint of providing Newtonian Viscosity characteristics and stability of the thickening effect under varying conditions of shear during pumping of the hydraulic fluid composition of the invention and is the preferred thickener of the invention. Generally, such thickeners are polyoxyalkylene polyols containing ethylene oxide and propylene oxide in the respective oxide ratio of between about 100:0 to about 70:30 (ethylene oxide-propylene oxide). The thickeners are commercially available and sold under the trademark "Ucon 75H-90,000" by Union Carbide and Carbon Chemical Corporation. This material has a pour point of 40° F., a flash point of 485° F., a specific gravity at 20° C. of 1,095, and a viscosity of about 90,000 S.U.S. at 100° F. By the use of such thickeners (and others such as those based upon polyvinyl alcohol and polyacrylates) in the hydraulic fluids of the invention, it is believed that wear resulting from cavitation as well as internal and external leakage during the pumping of such hydraulic fluids can be avoided to a substantial extent.

In evaluating the hydraulic fluids of the invention, a test generally referred to as the Vickers Vane Pump Test is employed. The apparatus used in this test is a hydraulic system which functions as follows: Hydraulic fluid is drawn from a closed sump to the intake side of a Vickers V-104E vane-type pump. The pump is driven by, and directly coupled to a 25 horsepower, 1740 rpm electric motor. The fluid is discharged from the pump through a pressure regulating valve. From there it passes through a calibrated venturi (used to measure flow rate) and back to the sump. Cooling of the fluid is accomplished by a heat exchanger through which cold water is circulated. No external heat is required; the fluid temperature being raised by the frictional heat resulting from the pump's work on the fluid. Excess heat is removed by passing the fluid through the heat exchanger prior to return on the sump. The Vickers V-104E vane-type pump comprises a cylindrical enclosure in which there is housed a so-called "pump cartridge". The "pump cartridge" assembly consists of front and rear circular, bronze bushings, a rotor, a cam-ring and rectangular vanes. The bushings and cam-ring are supported by the body of the pump and the rotor is connected to a shaft which is turned by an electric motor. A plurality of removable vanes are inserted into slots in the periphery of the rotor. The cam-ring encircles the rotor and the rotor and vanes are enclosed by the cam-ring and the bushings. The inner surface of the cam-ring is cam shaped. Rotating the rotor results in a change in displacement of each cavity enclosed by the rotor, the cam-ring, two adjacent vanes and the bushings. The body is ported to allow fluid to enter and leave the cavity as rotation occurs.

The Vickers Vane Pump Test procedure used specifically requires charging the system with five gallons of the test fluid and running at temperatures ranging from 100° to 135° F. at 1000 psi pump discharge pressure (load). Wear data were made by weighing the ring and the vanes of the "pump cartridge" before and after the test. At the conclusion of the test run and upon disassembly for weighing, visual examination of the system was made for signs of deposits, varnish, corosion, etc.

In addition to the Vickers Vane Pump Test for evaluating the hydraulic fluids and metalworking fluids of the invention, the extreme pressure properties of these fluids were tested utilizing the Shell 4-ball tester which is the standard testing device on lubricants. The tests were run at a 100 kilogram load, 1500 rpm and at room temperature utilizing 50 to 100 steel balls. The results of the Shell 4-ball Test show that decreased scar diameter results utilizing the hydraulic fluids of the invention thus indicating that the use of an alkylaryl phosphate ester in combination with an alkyldialkanolamide, a polyester of an oxyalkylene compound, provides improved extreme pressure properties over compositions of the prior art containing only a dialkyl phosphate ester as an antiwear lubricant.

The Ultrasonic Cavitation Errosion Test of ASTM D-2966, hereby incorporated by reference, was used as a laboratory test procedure for the evaluation of the hydraulic fluids and metalworking fluids of the invention. Generally, the Ultrasonic Cavitation Errosion Test used involves subjecting metal specimens to the test conditions while the specimens are totally immersed in a 33 percent by weight hydraulic fluid concentrate, the remaining liquid being water. The test is run over a period of 72 hours at a temperature of $82° \neq 2°$ C. in a tank using ultrasonic energy to produce a cavitation effect. Upon conclusion of the test, comparison is made of the average weight loss in grams incurred by the specimens under test against the weight loss of specimens in a reference coolant solution.

The following examples more fully describe the hydraulic fluids of the invention and show the unexpected results obtained by their use. The examples are intended for the purpose of illustration and are not to be construed as limiting in any way. All parts, proportions, and percentages are by weight and all temperatures are in degrees centigrade unless otherwise noted.

EXAMPLE 1

A hydraulic fluid was prepared by blending 84.5 parts by weight of water, 3 parts by weight of phosphate ester, 1.5 parts by weight of an alkyldiethanolamide, 1.5 parts by weight of a polyester made by esterifying a polyethylene glycol of 400 molecular weight with an alkyl dicarboxylic acid having 21 carbon atoms in the chain, 5 parts by weight of 2-methyl-2-amino-1-propanol, 4.5 parts by weight of a 50 percent by weight aqueous solution of sodium tolyltriazole, 0.20 parts by weight of a 50 percent aqueous 2-heptyl-1-(ethoxypropionic acid) imidazoline, and 3 parts by weight of benzoic acid.

The phosphate ester utilized is produced by the reaction of one mole of phosphorus pentoxide with a condensation product of one mole of nonylphenol and 4 moles of ethylene oxide in accordance with the methods disclosed in U.S. Pat. Nos. 3,004,056 and 3,004,057.

The alkyldiethanolamide used is prepared in accordance with the following procedure.

Preparation of N,N,2-dihydroxyethyldiamide of $C_{21}$ Dicarboxylic Acid

Into a 2 liter round bottom flask equipped with a Dean-Stark trap (condenser attached), stirrer and thermometer, 360.0 grams (1 mole) of $C_{21}$ diacid, and 200.0 grams (1.8 mole) of polymerization grade diethanolamine were added. In addition, 250 milliliters of m-xylene were used for azeotroping out the reaction water. The reaction water began to form and distill over at 136° C. The temperature of the reaction mixture in the flask was maintained at 150° C. After 6 hours of refluxing time, the required amount of reaction water (36 milliliters) was collected and the reaction was stopped. Then, a vacuum of 1 milliliter Hg was applied to the system to strip off excess m-xylene and any additional reaction water. Product yield was 502.9 grams or 96 percent.

A clear to slightly hazy, free-flowing water-based hydraulic fluid is obtained which is stable to storage at room temperature.

EXAMPLE 2

(Comparative Example Forming No Part of This Composition)

A hydraulic fluid of the prior art was prepared by blending 82.9 parts by weight of water with 6 parts by weight of a dialkyl phosphate ester, 5 parts by weight of 2-methyl-2-amino-1-propanol, 4.5 parts by weight of a 50 percent by weight aqueous solution of sodium tolyltriazole, and 1.6 parts by weight of ethylene diamine tetraacidic acid tetrasodium salt.

Unless this composition includes an effective amount of the ethylene diamine tetraacidic acid tetrasodium salt (EDTA-Na salt) as a chelating agent, the admixture of this hydraulic fluid with tap water containing calcium and magnesium ions (5–100 parts per million) will cause precipitates to form. The EDTA-Na salt detracts from the aluminum cavitation errosion properties of the hydraulic fluid.

The Shell 4-ball test method, which is a standard test method for lubricants, was used to evaluate extreme pressure properties of the hydraulic fluids of the invention. In these tests, a 7.5 kilogram load at 1800 rpm was used at room temperature using 52,100 steel balls. It was found that, when this composition is diluted with 20 parts by weight of tap water and evaluated for extreme pressure properties, that the scar diameter was 0.696 inches. A similar test run utilizing the composition of Example 1 showed a scar diameter of 0.443 inches.

Evaluation of the hydraulic fluids of Examples 1 and 2 utilizing the Ultrasonic Cavitation Errosion Test of ASTM D-2966 indicates considerably improved results for the hydraulic fluid of Example 1. The test was performed utilizing a concentration of 33 parts by weight hydraulic fluid concentrate with 67 parts of tap water. Results are shown in the following table.

TABLE

| Hydraulic Fluid (33% by Weight Concentration in Water) | Cavitation Errosion Test: Grams Lost During Test | | |
|---|---|---|---|
| | Cast Aluminum | Cast Iron | 1020 Milled Steel |
| Example 1 | 4.6 | 0.3 | 0.6 |
| Example 2 | 383 | 9 | 4 |

EXAMPLE 3

A hydraulic fluid was prepared by blending 78.5 parts by weight of water, 3 parts by weight of the phosphate ester of Example 1, 1.5 parts by weight of the alkyldiethanolamide of Example 1, 1.5 parts by weight of the ethoxylated polyester of Example 1, 4.5 parts by weight of a 50 percent by weight aqueous solution of tolyltriazole, 5 parts by weight of 2-methyl-2-amino-1-propanol, and 4 parts by weight of 2-heptyl-1-(ethoxypropionic acid)imidazoline, sodium salt. A clear, free-flowing, water-based hydraulic fluid is obtained which is stable to storage at room temperature and to dilution with tap water and water containing up to 1000 parts per million of hardness calculated as calcium and magnesium ions. Evaluation for extreme pressure properties using the Shell 4-ball test method in accordance with the method described in Example 2 resulted in a scar diameter of 0.43 inches. The hydraulic fluid of this example was also evaluated in the Vickers V-104E vane pump. After 20 hours under test, the total wear on the ring and vanes in milligrams was 481.

While this invention has been described with reference to certain specific embodiments, it will be recognized by those skilled in the art that many variations are possible without departing from the scope and spirit of the invention.

The embodiments of the invention in which an exclusive property or privilege is claimed are defined as follows:

1. A composition useful as a hydraulic fluid or metalworking fluid consisting essentially of water in a major proportion and minor effective lubricating amounts of:

(A) a phosphate ester salt selected from the group consisting of

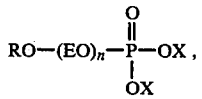

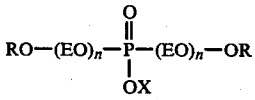

and mixtures thereof wherein EO is ethylene oxide; R is an alkylaryl group wherein the alkyl group thereof has about 4 to about 20 carbon atoms; X is individually selected from the group consisting of an alkali metal, an alkaline earth metal, the residue of ammonia, the residue of an amine, and mixtures thereof; n is a number from 1 to 50, (B) an alkyldialkanolamide of the formula:

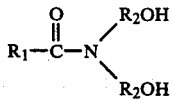

wherein $R_1$ is alkyl of about 4 to about 54 carbon atoms and $R_2$ is alkyl of about 2 to about 6 carbon atoms, or an alkyldialkanolamide prepared by esterifying a dialkanolamine with an alkyl carboxylic acid and removing water of esterification wherein said alkyldialkanolamide is derived from a branched or straight chain, saturated or unsaturated aliphatic dicarboxylic acid having 8 to 54 carbon atoms.

2. The composition of claim 1 wherein said phosphate ester is the ester of one mole of phosphorus pentoxide and one mole of the condensation product of an alkyl phenol having 4 to 20 carbon atoms in the alkyl group with 5 to 20 moles of ethylene oxide.

3. The composition of claim 2 wherein said alkyl phenol is selected from the group consisting of nonyl phenol, dinonyl phenol, dodecyl phenol, and mixtures thereof.

4. The composition of claim 3 wherein said alkyldialkanolamide is an alkyl diethanolamide having 4 to 30 carbon atoms in the alkyl group thereof.

5. The composition of claim 4 wherein the ratio of said phosphate ester or said ethoxylated water-soluble aliphatic ester to said alkyl-diethanolamide is about 0.1:1 to about 2:1 by weight and said alkyl group contains 21 carbon atoms.

6. The composition of claim 5 additionally containing about 0.5 to about 5 percent of the alkali metal salt of tolyltriazole and about 0.5 percent by weight to about 5 percent by weight of an imidazoline of the formula:

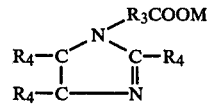

wherein $R_3$ is a divalent radical selected from the group consisting of alkyl and alkoxy radicals having 2 to 18 carbon atoms and where alkoxy derived from alkylene oxides selected from the group consisting of ethylene oxide, propylene oxide, butylene oxide, tetrahydrofuran and mixtures thereof and wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, and wherein M is an alkali metal.

7. The process of metalworking comprising working metal in the presence of the composition of claim 1.

8. The process for transmitting force hydraulically comprising transmitting force utilizing the composition of claim 1.

9. The method of lubricating metal comprising the step of applying to the metal elements to be lubricated a liquid, water-based lubricating composition comprising the composition of claim 1.

10. The process of claim 9 wherein said composition comprises a mixture of an alkylaryl phosphate ester derived from the reaction of one mole of phosphorus pentoxide and one mole of the condensation product of one mole of nonylphenol and two to ten moles of ethylene oxide and wherein said alkyl-dialkanolamide is an alkyl-diethanolamide having 4 to 30 carbon atoms in the alkyl group.

11. The process of claim 10 wherein the ratio of alkylaryl phosphate ester or ethoxylated water-soluble aliphatic ester to alkyl-dialkanolamide is about 0.1:1 to about 2:1 by weight.

* * * * *

UNITED STATES PATENT AND TRADEMARK OFFICE

CERTIFICATE OF CORRECTION

PATENT NO. : 4,342,658

DATED : August 3, 1982

INVENTOR(S) : Cline A. Tincher and Jerrold F. Maxwell

It is certified that error appears in the above-identified patent and that said Letters Patent is hereby corrected as shown below:

Claim 1, column 10, line 2, delete the period after "atoms", insert a comma therefore, and add the following:

"and (C) a water-soluble polyoxyethylated aliphatic ester consisting of esters of ethoxylated aliphatic monohydric and polyhydric alcohols and aliphatic acids, wherein said alcohols have about 5 to about 20 moles of ethylene oxide added per mole of alcohol, said alcohols have carbon chain lengths of about 8 to about 36 carbon atoms, said acids have carbon chain lengths of about 8 to about 54 carbon atoms, and wherein said esters are produced by first polyoxyethylating at least one of said alcohols and second obtaining the ester reaction product thereof."

Signed and Sealed this

Seventeenth Day of May 1983

[SEAL]

Attest:

DONALD J. QUIGG

Attesting Officer

Acting Commissioner of Patents and Trademark